US007168427B2

(12) United States Patent
Bachinski et al.

(10) Patent No.: US 7,168,427 B2
(45) Date of Patent: Jan. 30, 2007

(54) AIR FILTRATION AND STERILIZATION SYSTEM FOR A FIREPLACE

(75) Inventors: Thomas J. Bachinski, Lakeville, MN (US); Gary Lee Butler, Silver Lake, MN (US)

(73) Assignee: HNI Technologies Inc., Muscatine, IA (US)

( * ) Notice: Subject to any disclaimer, the term of this patent is extended or adjusted under 35 U.S.C. 154(b) by 0 days.

(21) Appl. No.: 10/848,834

(22) Filed: May 17, 2004

(65) Prior Publication Data

US 2005/0011512 A1 Jan. 20, 2005

Related U.S. Application Data

(63) Continuation of application No. 10/119,640, filed on Apr. 9, 2002, now Pat. No. 6,736,133.

(51) Int. Cl.
*F24B 1/189* (2006.01)

(52) U.S. Cl. ..... 126/521; 126/507

(58) Field of Classification Search ..... 126/521 O, 126/507 X, 533, 500
See application file for complete search history.

(56) References Cited

U.S. PATENT DOCUMENTS

| | | | | |
|---|---|---|---|---|
| 3,910,252 A | | 10/1975 | Richard | |
| 3,930,490 A | * | 1/1976 | Lassy et al. | 126/522 |
| 4,252,106 A | | 2/1981 | Estes | |
| 4,257,338 A | | 3/1981 | Chasek | |
| 4,350,504 A | | 9/1982 | Diachuk | |
| 4,836,182 A | | 6/1989 | Trowbridge | |
| 5,054,468 A | * | 10/1991 | Moon et al. | 126/512 |
| 5,307,801 A | * | 5/1994 | Schroeter et al. | 126/515 |
| 5,566,667 A | | 10/1996 | Cox | |
| 5,656,242 A | | 8/1997 | Morrow et al. | |
| 5,702,244 A | | 12/1997 | Goodson et al. | |
| 5,839,428 A | * | 11/1998 | Schroeter et al. | 126/512 |
| 5,960,789 A | * | 10/1999 | Fleming | 126/512 |
| 5,979,437 A | | 11/1999 | Eberhardt | |
| 6,216,687 B1 | * | 4/2001 | Campbell et al. | 126/512 |
| 6,289,974 B1 | | 9/2001 | DeGregoria et al. | |

(Continued)

FOREIGN PATENT DOCUMENTS

GB 2 076 518 12/1981

OTHER PUBLICATIONS

"Bioworld," "Bio-world.com—The Online Source for Molecular Tools and Laboratory Essentials," http://www.bio-world.com/MoreInfo.asp?ItemCode=544504, 1 page, last printed Mar. 18, 2002.

(Continued)

*Primary Examiner*—Alfred Basichas
(74) *Attorney, Agent, or Firm*—Faegre & Benson LLP

(57) ABSTRACT

An air filtration and sterilization system for removing airborne contaminants from air circulated through an air plenum system of a fireplace. Air filtration systems may include particulate, chemical, and ion filtration systems to filter the air. Air sterilization may include ultraviolet, ozone, germicidal coating, and channeled system of ducts systems to sterilize the air. Systems may be used individually or in combination. In addition, optional components, including a warning sensor for indicating when to replace a filter, an automatic initiation sensor for activating and stopping filtration and sterilization, and an air enhancement system for introducing desirable materials into the air, may be provided.

14 Claims, 10 Drawing Sheets

U.S. PATENT DOCUMENTS

| | | | | |
|---|---|---|---|---|
| 6,320,086 | B1 * | 11/2001 | Suyama et al. | 568/771 |
| 6,666,206 | B1 * | 12/2003 | Myrick | 126/522 |
| 6,736,133 | B2 * | 5/2004 | Bachinski et al. | 126/521 |

OTHER PUBLICATIONS

"Clearflite Air Purifiers," "Air Purifiers—clean and healthy indoor air," http://www.airpurifiers.com/select.htm, 3 pages (1994).

"Dust Free," "Dust Free Bio-Fighter UV Light Systems," http://www.dustfree.com/uv/index.htm, 4 pages. (2000).

"Dwyer®," "Series DCT1000 Dust Collector Timer Controller," https://www.dwyer-inst.com/htdocs/pressure/dct1000.html, pp. 1-2 (2001).

"Dwyer®," "Series DS Flow Sensors," https://www.dwyer-inst.com/htdocs/flow/DS.html, pp. 1-4 (2001).

"Dwyer®," "Pressure: Table of Contents," https://www.dwyer-inst.com/2002_cover/table_contents_pressure.html, pp. 1-7 (2001).

"Lesker," "Particle Separators," http://www.lesker.com/CFDOCS/newweb/Traps_and _Filters/ForelineFilters/PartSep.cfm, 1 page, last printed Mar. 18, 2002.

"The Nando Times," "Health & Science: Bacteria killed by special polymer coating, study finds," http://archive.nandotimes.com/healthscience/story/0.1080.500561632-500803510-50439745, 3 pages. (2002).

"Pure n Natural," "AllerAir 5000-UV Air Purifier," http://www.purennatural.com/prod_desc.php3?prod_id=632 1 page, last printed Mar. 12, 2002.

"Pure n Natural," "Clairity High Density Negative Ionizer, " hhttp://www.purennatural.com/prod_desc.php3?prod_id=425, 1 page, last printed Mar. 12, 2002.

"Pure n Natural," "EnviroSept Electronic Air Cleaner," http://www.purennatural.com/prod_desc.php3?prod_id=33, 1 page, last printed Mar. 12, 2002.

"Pure n Natural," "IQAir HealthPro Plus," http://www.purennatural.com/prod_desc.php3?prod_id=377, 1 page, last printed Mar. 12, 2002.

"Pure n Natural," "MiracleAir Air Cleaner," http://www.purennatural.com/prod_desc.php3?prod_id=96, 1 page, last printed Mar. 12, 2002.

"Pure n Natural, " "NaturalAir GOLD NAG-6000 Air Purifier, " http://www.purennatural.com/prod_desc.php3?prod_id=481, 1 page, last printed Mar. 12, 2002.

"Pure n Natural," "NaturalAir NA-2000 Air Purifier," http://www.purennatural.com/prod_desc.php3?prod_id=325, 1 page, last printed Mar. 12, 2002.

"Pure n Natural," "The "Odor Zapper" OZ 2000 Sanitizing Ozone Generator," http://www.purennatural.com/prod_desc.php3?prod_id=644, 1 page, last printed Mar. 18, 2002.

* cited by examiner

AIR FILTRATION AND STERILIZATION SYSTEM FOR A FIREPLACE

This application is a continuation of application Ser. No. 10/119,640, filed Apr. 9, 2002, now U.S. Pat. No. 6,736,133 application is incorporated herein by reference.

TECHNICAL FIELD

The present invention relates to fireplaces. More particularly, the invention relates to an air filtration and sterilization system for a fireplace.

BACKGROUND

Fireplaces have become increasingly commonplace in homes, businesses, and other buildings. A fireplace may provide many benefits, including the creation of heat as well as an aesthetically-pleasing arrangement of flames, sounds, and smells. A fireplace is typically mounted in a wall of a structure and includes one or more air passages running into and out of the fireplace. The plurality of passages creates an air plenum system. A portion of the air plenum system typically includes one or more air intakes coupled to passages used to take room air, or air from the room in which the fireplace is disposed, and direct the room air through passages running adjacent to the combustion chamber. The room air is heated as it passes adjacent to the combustion chamber and is eventually exhausted through an air exhaust back into the room. One or more blowers may also be placed within the air plenum system to increase the circulation of room air through the fireplace. In this manner, the amount of heat delivered to a room may be significantly increased.

While the room air that is passed through the air plenum system is heated by the fireplace, no other conditioning of the air is typically done. However, the construction of modern homes and buildings cause rooms within them to act as sealed environments, and the air trapped in these rooms can become stale. Even worse than that, airborne contaminants such as allergens, viruses, dust, microorganisms, and other undesirable pollutants can become trapped in the air and circulated throughout the structure. The circulation of air through a fireplace can contribute to the distribution of these contaminants.

Therefore, it would be desirable to create a fireplace that can provide the typical benefits of a fireplace, such as the creation and distribution of heat, while reducing or eliminating undesired airborne contaminants.

SUMMARY

Generally, the present invention relates to fireplaces. More particularly, the invention relates to an air filtration and sterilization system for a fireplace.

In one aspect, the invention relates to a fireplace including an air filtration system, the fireplace comprising an enclosure, at least one panel positioned relative to the enclosure to form a plenum system defining an air passage, a HEPA filter disposed within the plenum system, and a blower disposed within the plenum system to move air through the air passage, wherein the blower causes the air to pass through the HEPA filter to remove airborne contaminants from the air.

In another aspect, the invention relates to a fireplace including an air filtration system, the fireplace comprising an enclosure, at least one panel positioned relative to the enclosure to form a plenum system defining an air passage, a first filtration system disposed within the plenum system, a second filtration system disposed within the plenum system, and a blower disposed within the plenum system to move air through the air passage, wherein the blower causes the air to pass through the first and second filtration systems, and wherein the first and second filtration systems remove airborne contaminants from the air.

In yet another aspect, the invention relates to a fireplace including an air sterilization system, the fireplace comprising an enclosure, at least one panel positioned relative to the enclosure to form a plenum system defining an air passage, a blower disposed within the plenum system to move air through the air passage, and an air sterilization system disposed within the air passage for sterilizing the air passing through the plenum system.

In another aspect, the invention relates to a fireplace including an air sterilization system, the fireplace comprising an enclosure, at least one panel positioned relative to the enclosure to form a plenum system defining an air passage, an ultraviolet system disposed within the plenum system, the ultraviolet system including at least one ultraviolet light bulb configured to emit ultraviolet light, and a blower disposed within the plenum system to move air through the air passage and adjacent the ultraviolet system, wherein the ultraviolet light emitted by the ultraviolet system sterilizes airborne contaminants contained in the air.

In yet another embodiment, the invention relates to a method for filtering air passing through a plenum system of a fireplace including steps of: providing a first filtration system including a HEPA filter; positioning the first filtration system in the plenum system; providing a second filtration system including an ion generator; positioning the second filtration system in the plenum system; passing air through the first filtration system to remove airborne contaminants in the air; and dispersing negative ions into the air with the second filtration system to capture airborne contaminants.

In another embodiment, the invention relates to a method for sterilizing air passing through a plenum system of a fireplace including steps of: providing a channel system defining a channeled system of passages coupled to the plenum system, wherein the channeled system of passages are configured to slow the air passing through the channeled system of passages; positioning the channeled system of passages adjacent an enclosure of the fireplace; disposing an ultraviolet system in the plenum system; and passing air through the plenum system and adjacent the ultraviolet system to sterilize the air and through the plurality of passages to slow and heat the air, thereby further sterilizing the air.

In another aspect, the invention relates to a fireplace including an air filtration system and an air sterilization system, the fireplace comprising an enclosure, at least one panel positioned relative to the enclosure to form a plenum system defining an air passage, means for filtering air circulated through the air passage, and means for sterilizing the air circulated through the air passage.

The above summary of the present invention is not intended to describe each disclosed embodiment or every implementation of the present invention. Figures in the detailed description that follow more particularly exemplify embodiments of the invention. While certain embodiments will be illustrated and describing embodiments of the invention, the invention is not limited to use in such embodiments.

BRIEF DESCRIPTION OF THE DRAWINGS

The invention may be more completely understood in consideration of the following detailed description of various embodiments of the invention in connection with the accompanying drawings, in which.

While the invention is amenable to various modifications and alternant forms, specifics thereof have been shown by way of example and the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

The invention is applicable to fireplaces. More particularly, the invention relates to air filtration and sterilization systems for a fireplace. While the present invention is not so limited, an appreciation of the various aspects of the invention will be gained through a discussion of the examples provided below.

Example air filtration and sterilization systems made in accordance with this invention may generally function to filter and sterilize air that circulates through a fireplace and back into a room in which the fireplace is located, thereby reducing and/or killing any airborne contaminants. As used herein, the term "filter" means to capture, attract, bond with, or otherwise remove airborne contaminants from the air and may include particulate filtration, chemical filtration, and ion filtration. The term "sterilize" means to kill, disinfect, or otherwise incapacitate airborne contaminants. The term "airborne contaminants" means any undesirable pollutant found in the air, such as, for example, viruses, bacteria, bio-organisms, pollen, dust mite particles, pet dander, mold spores, fungi, harmful fibers, soot, smoke, radioactive particles, gaseous and odor-causing chemicals, etc.

One or more of the systems and methods provided below may be used to filter and sterilize the air that circulates through a fireplace. While example embodiments of air filtration and sterilization systems and methods are described, other systems and methods for filtering and sterilizing, or combinations thereof, may also be used without departing from the spirit of the invention.

I. Air Filtration Systems

A. Particulate Filtration

Figure 1:
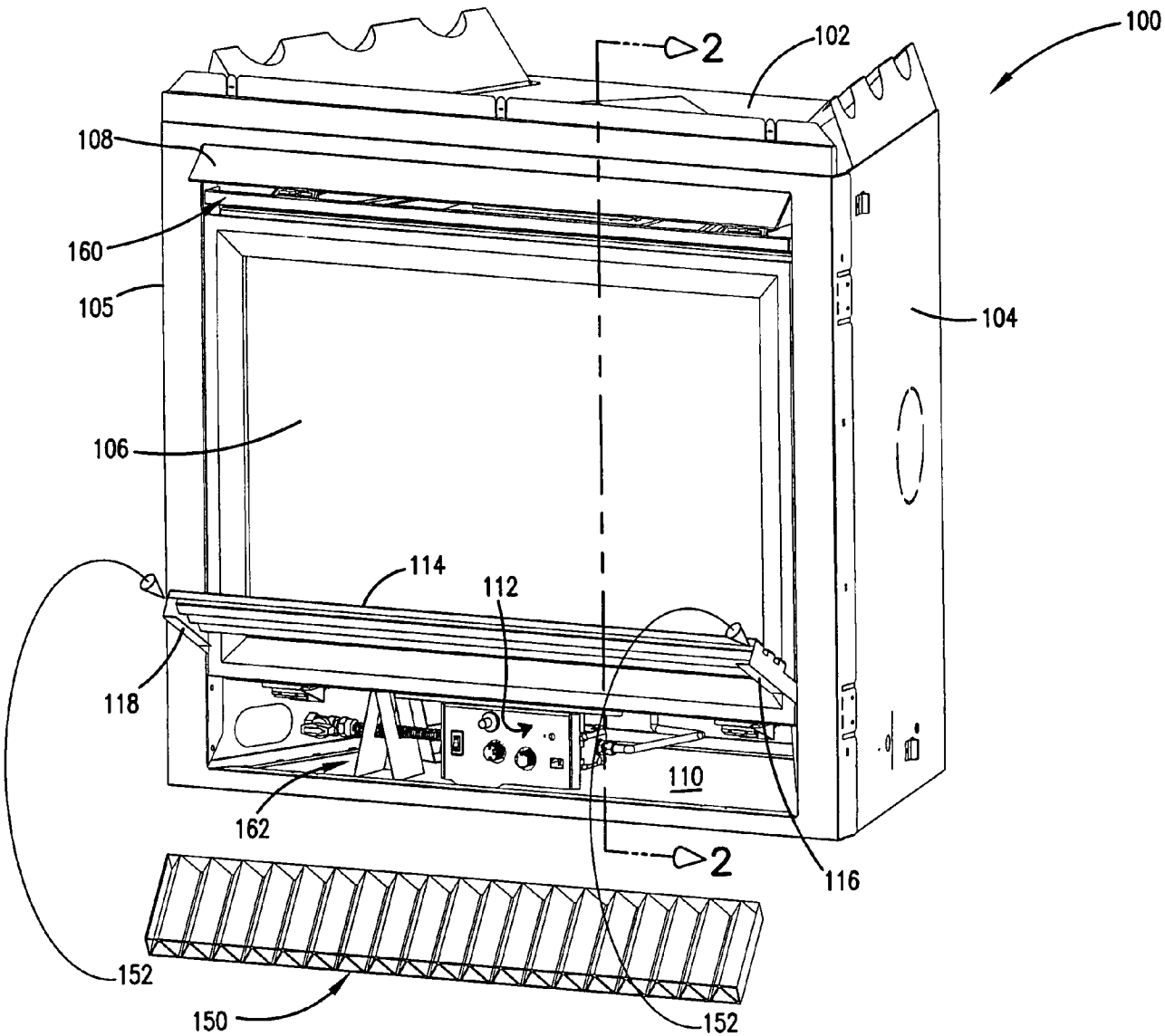
FIG. 1 is a schematic front perspective view of an example fireplace including example embodiments of air filtration systems made in accordance with the present invention.
Figure 2:
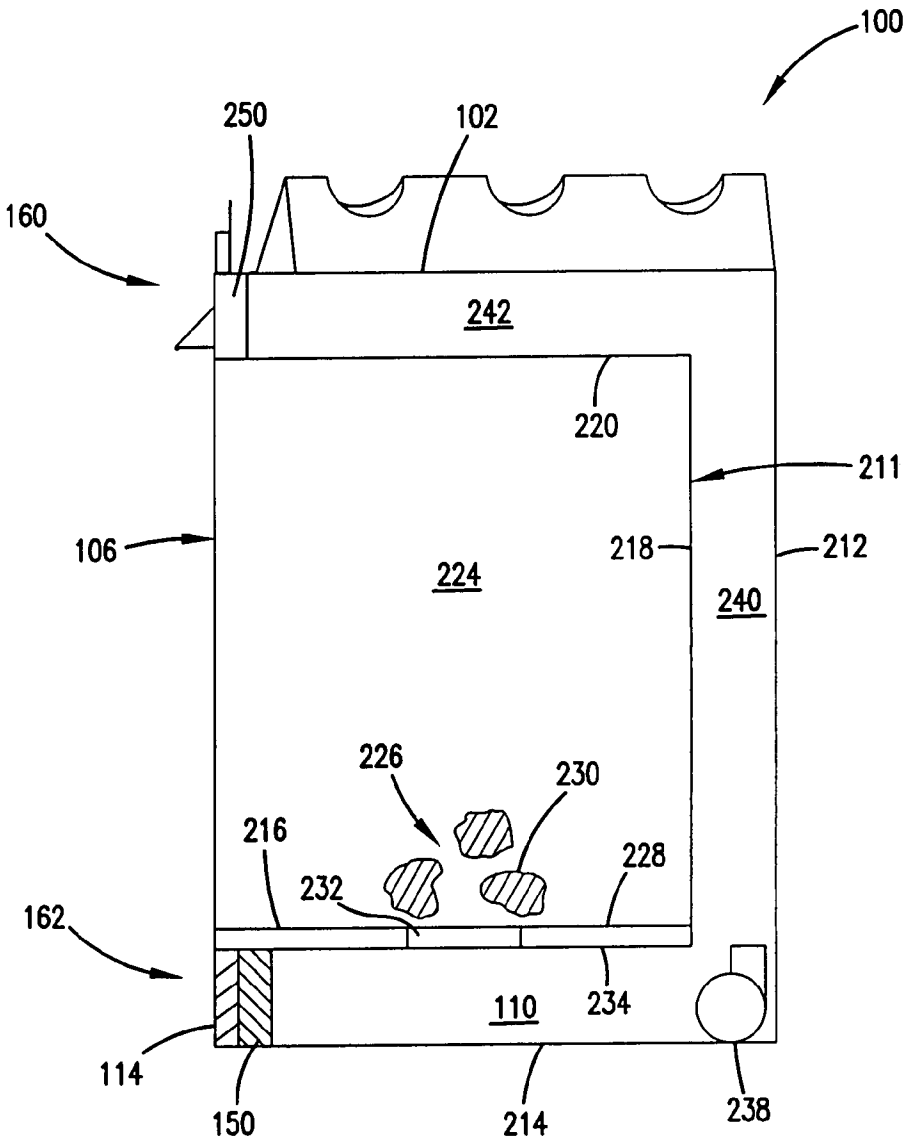
FIG. 2 is a schematic side cross-sectional view taken along line 2—2 of the fireplace of FIG. 1.

Referring now to FIGS. 1 and 2, an example fireplace 100 is shown. A fireplace may generally include an enclosure in which heat is generated. FIG. 1 illustrates a front perspective view of the fireplace 100, and FIG. 2 shows a cross-sectional view taken along line 2—2 of FIG. 1. The fireplace 100 includes a top panel 102, side panels 104 and 105, and a front panel 106. Also included is a hood 108 positioned adjacent a room air exhaust opening 160 and a grill 114 positioned to swingingly cover a room air intake opening 162. Disposed within a passage 110 positioned at the bottom of the fireplace 100 is a combustible gas source 112 that provides gas to a burner 232.

A combustion chamber 224 is defined by a plurality of interior panels including panels 216, 218, and 220 that form an enclosure 211. Although the term enclosure will be used throughout in connection with the combustion chamber 224, the term enclosure may include any enclosure in which flames and/or heat are generated or simulated, whether the fireplace is a solid-fuel, gas, electric, or other known simulated fireplace.

A front portion of the front panel 106 is typically made of tempered glass or ceramic glass that allows for viewing into the combustion chamber 224. Alternatively, in simulated fireplaces that do not generate heat, a clear plastic or other transparent material may be used to allow viewing into the combustion chamber 224.

The passage 110 is formed between a bottom panel 214 and the interior panel 216. Likewise, a passage 240 is formed between a back panel 212 and the panel 218, and a passage 242 is formed between the top panel 242 and the panel 220. The passages 110, 240, and 242 are fluidly coupled to one another to create an air plenum or air passage system. In addition, a blower 238 is disposed within the passage 110. Other optional components of the fireplace 100 may include a combustible air exhaust pipe (not shown) that may be coupled to the combustion chamber 224 and a burner system 226 comprising the burner 232 coupled to the combustible gas source 112 and positioned within a floor 228. Also included are artificial logs 230.

The fireplace 100 is provided by example only, and any fireplace configured in a similar manner may be used. For example, although the fireplace 100 is illustrated as a gas fireplace, solid-fuel burning or electrical fireplaces may also be used. In addition, the configuration of the air plenum system and other components of the fireplace 100 may also be modified as needed without departing from the scope of the invention. For example, the present invention may be applicable to any prefabricated fireplace such as a direct vent, a universal vent, a B-vent, a horizontal/vertical-vent, a dual direct vent, or a multisided unit.

Referring again to FIG. 1, an example embodiment of a filter 150 is shown made in accordance with the present invention. The example filter 150 is configured to be inserted into a spacing 152 defined by the grill 114 and tabs 116 and 118 coupled to and spaced apart from the grill 114. The filter 150 may be inserted into the spacing 152 so that the filter 150 is held adjacent to the grill 150, and the grill 150 may then be swung into place covering the air intake opening 162. Other configurations for holding the filter 150 in place may also be used such as, for example, separate clips, screws, bolts, etc.

In this example embodiment of the invention, the filter 150 comprises pleated filter material. For example, in one embodiment, the filter 150 is a HEPA filter. The term "HEPA filter," as is known to those skilled in the art, may stand for "High Efficiency Particle Air" filter, "High Efficiency Particle Aerosol" filter, or "High Efficiency Particle Arrestor" filter. A HEPA filter is typically made from glass fiber, glass-asbestos fiber, or other equivalent material. A HEPA filter may be categorized according to different filter standards such as, for example, a "true" HEPA filtering at least 99.97% of 0.3 micron diotylphthalate particles, or a "ASHRAE" HEPA filtering at least 85% Dust-Spot Efficiency percentage as measured by the American Society of Heating, Refrigerating and Air Conditioning Engineers, Inc. (ASHRAE) standard. A HEPA filter may also be referred to as an "S-Class" filter in Europe.

As used herein, the term "HEPA filter" may be understood to mean any of the filters described above or otherwise known to those skilled in the art. The filter 150 may be any type of HEPA filter described above or known in the art.

The filter 150 may preferably be positioned in the air passage 110 below the combustion chamber 224 to limit exposure of the filter 150 to the heat generated in the combustion chamber 224 and thereby maximize the filter's efficiency and useful life. Alternatively, if it is desirable to place the filter 150 in another portion of the air plenum, for example, the passages 240 or 242, heat shields and/or insulation can be placed between the combustion chamber 224 and the filter 150 to protect the filter from heat generated in the combustion chamber 224.

Other filters besides a HEPA filter can also be used. For example, an electrostatic or dielectrically polarized filter may be used consisting of fine synthetic fibers on which an electric charge is built to electrically attract and filter out unwanted airborne contaminants. Other filters, made from, for example, cotton, sateen, polyester, propropylene, and/or other natural and synthetic materials may also be used. In addition, other filters such as, for example, particulate separators, utilizing centrifugal and gravitational forces, can also be used to remove particulate from the air.

In an alternative embodiment (not shown), a foam filtration media may also be used to filter airborne contaminants such as, for example, visible particulates. The foam filtration media may be formed as a sheet or mat and may be, for example, coupled to a front surface of the filter 150. The foam filtration media may be cleanable. The foam filtration media may be removed from the fireplace and washed to remove airborne contaminants trapped within or on the foam filtration media. Alternatively, the foam filtration media may be replaceable as needed.

B. Chemical Filtration

In addition to particulate filtration, filtration systems may include other filter material that can be used to chemically filter out unwanted airborne contaminants such as, for example, unwanted odors and/or chemicals. For example, a carbon filter comprising activated granulated carbon or woven carbon fibers may be used to filter out unwanted odors and other chemicals from the air. The carbon filter may be, for example, manufactured as part of the filter 150. Alternatively, the carbon filter may be separate from the filter 150.

Other chemical filtration systems can also be used. For example, filters including a blended media of coconut shell carbon and zeolite and/or activated alumina impregnated with potassium permanganate may also be used to reduce unwanted airborne contaminants.

C. Ion Filtration

Referring again to FIG. 2, an example embodiment of another air filtration system including an ion filtration system 250 is shown made in accordance with the present invention. The system 250 is disposed in the passage 242 positioned adjacent the air exhaust opening 160. In an example embodiment, the system 250 may include an ion generator. An ion generator may create negatively charged ions that are released into the air and flow through the air passage 242 as the air exits through the air exhaust 160. These negative ions are attracted to and attach themselves to airborne contaminants. The resulting combination of negative ion and contaminant particle is large enough that it falls out of the breathable air. The filter 250 may be placed at or near the air exhaust 160 so that the negative ions generated by the filter 250 can exit into the air in the room and bind with air contaminants. Alternatively, the filter 250 may be placed in the passage 110 below the combustion chamber 224 so that the exposure to heat from the combustion chamber 224 is minimized. Other filter placement is also possible.

II. Operation of an Example Fireplace Including Air Filtration Systems

A fireplace 100 with an air filtration system including filter 150 and ion filtration system 250 may function as follows. Air from the room may be drawn into the fireplace 100 by, for example, the blower 238. Room air that enters the air intake 162 is filtered by the filter 150 as it passes into the passage 110, thereby removing airborne contaminants. The room air is then directed through passages 110, 240, and 242 as it is warmed by the heat generated in the combustion chamber 224. The room air then passes adjacent the ion filtration system 250, at which a plurality of negative ions are dispersed throughout the air. As the room air exits the air exhaust 160 into the room, the negative ions may bond to any remaining air contaminants, causing them to fall to the ground and out of the breathable air. These contaminants can then be removed from the ground by vacuuming or other known cleaning methods.

III. Air Sterilization Systems

Various air sterilization systems and methods may be used to sterilize the air circulating through a fireplace. Several example embodiments of sterilization systems for a fireplace are described below. These sterilization systems may, but need not, be used in conjunction with one or more of the filtration systems described above.

A. Ultraviolet Sterilization System

Figure 3:
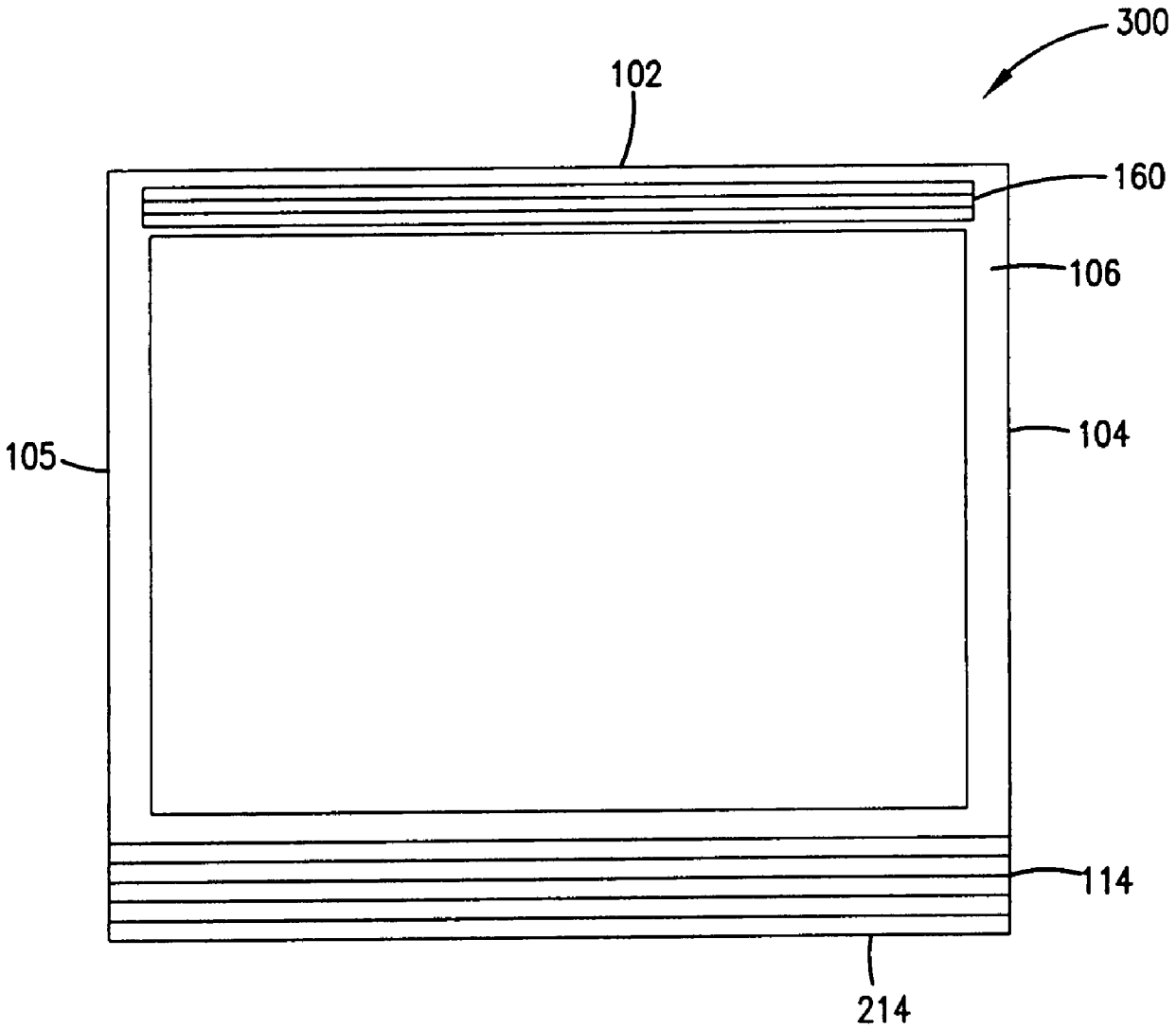
FIG. 3 illustrates a schematic front view of another example fireplace including example embodiments of air filtration and sterilization systems made in accordance with the present invention.
Figure 4:
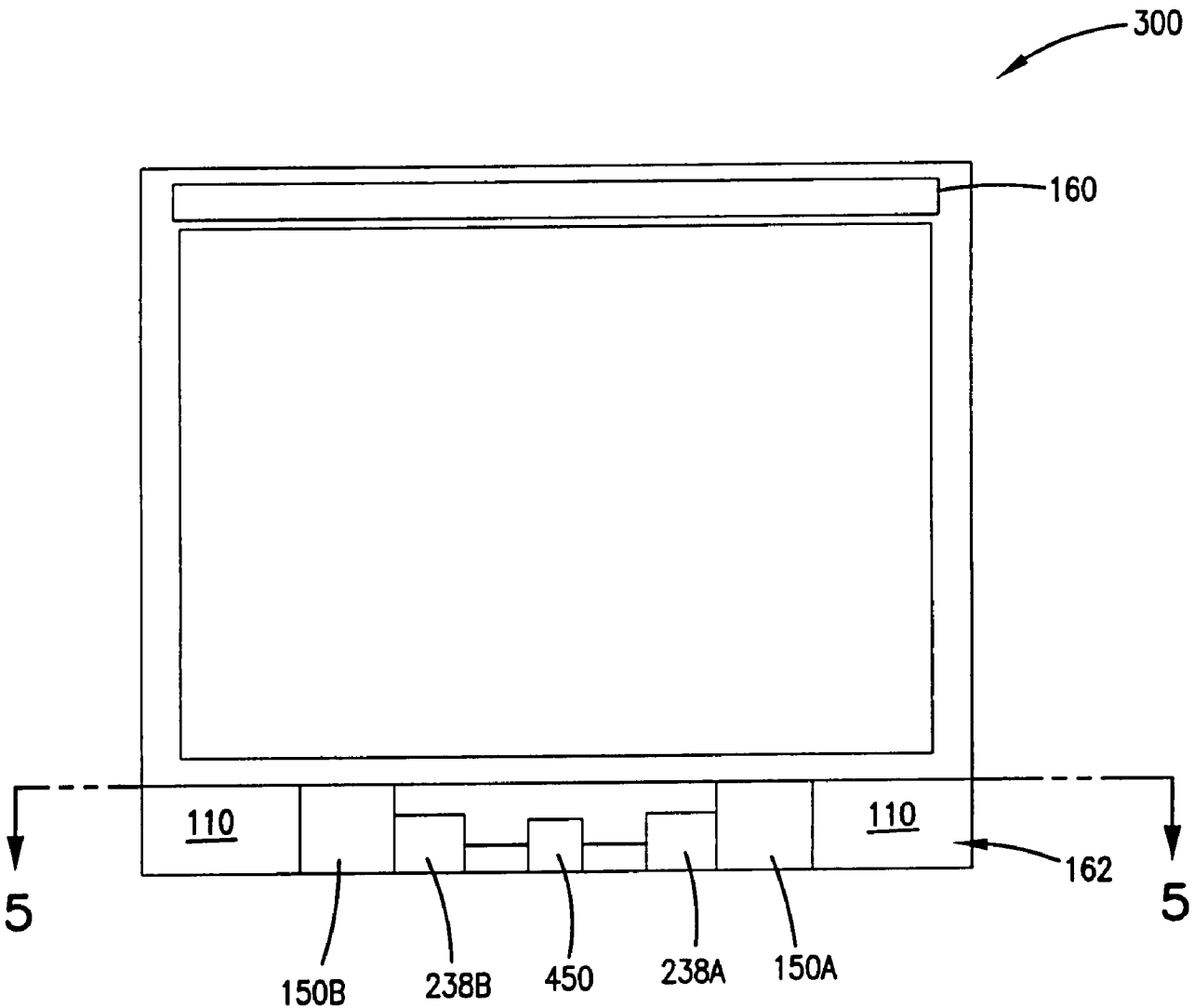
FIG. 4 illustrates the fireplace of FIG. 3 with the grills removed, exposing the air intake and air exhaust openings and the example air filtration and sterilization systems.
Figure 5:
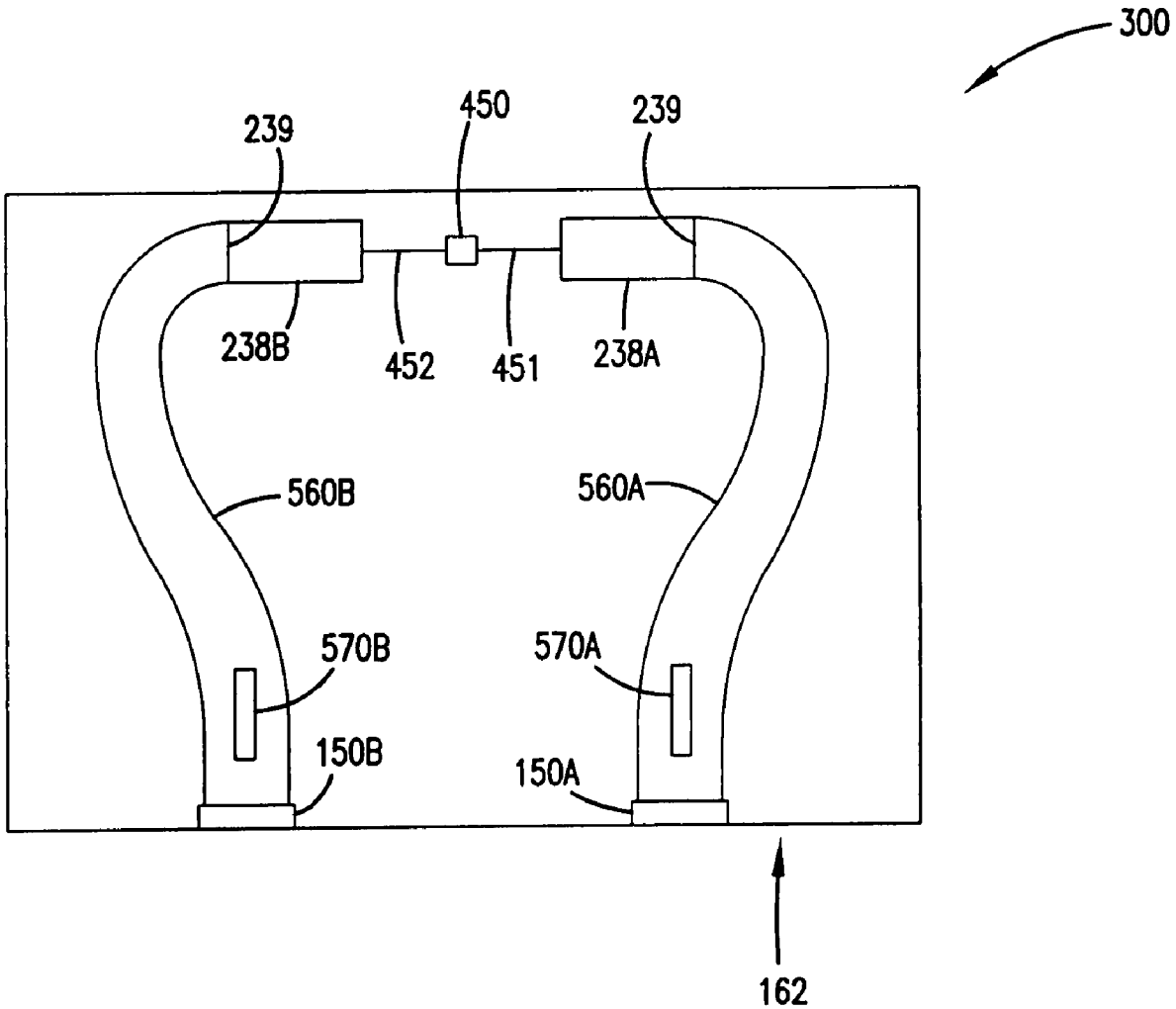
FIG. 5 shows a schematic bottom cross-sectional view taken along line 5—5 of the fireplace of FIG. 4.

Referring now to FIGS. 3–5, another example embodiment of a fireplace 300 is illustrated including an example sterilization system made in accordance with the present invention. The fireplace 300 is similar to that of the fireplace 100, and like components have been identically numbered. However, many of the components of the fireplace 300 have been removed to enhance clarity.

Reference is now made to FIG. 4, in which the grill 114 has been removed from the fireplace 300, exposing the air intake opening 162 and the passage 110, and FIG. 5, in which a cross-sectional view taken along line B—B of FIG.

4 is provided. Disposed within the passage 110 are filters 150A and 150B coupled to flexible ducts 560A and 560B, which are in turn coupled to blowers 238A and 238B and motor 450.

Air may enter the room air intake opening 162 and circulate through the fireplace 300 through at least two paths. A first path is identical to that described with reference to the fireplace 100 and includes air entering the opening 162, traveling through the passage 110, up the passage 240, through the passage 242, and out through the exhaust opening 160.

A second path through which air may enter the fireplace 300 includes air drawn through the filters 150A and 150B and into the ducts 560A and 560B by the blowers 238A and 238B. The blowers 238A and 238B are driven by the motor 450 through the shafts 451 and 452. The blowers 238A and 238B may be formed in a paddle-wheel configuration, so that the blowers draw air into the blowers at ends 239 coupled to the ducts 560A and 560B and exhaust the air upwards into the passage 240. The air exhausted from the blowers 238A and 238B mixes with other air traveling in the passages 240 and 242 and is eventually exhausted through the exhaust opening 160.

It may be advantageous to use the ducts 560A and 560B because only the surface area at the inlet to the ducts 560A and 560B is filtered by the filters 150A and 150B, allowing additional air to enter the opening 162 surrounding the ducts 560A and 560B and cool the combustion chamber 224. This may be important, for example, if power to the blowers 238A and 238B is lost, thereby reducing the amount of air flowing through the air filtration and/or sterilization systems. If the blowers 238A and 238B are not operational, air may still enter the opening 162 and flow around the filtration and sterilization systems through passages 110, 240, and 242 and thereby maintain the necessary temperature for external surfaces of the fireplace 300.

Disposed within the ducts 560A and 560B is an ultraviolet (UV) sterilization system including germicidal UV light bulbs 570A and 570B. The UV light bulbs 570A and 570B may emit UV light at a given wavelength, typically between 180 nm and 400 nm. UV light bulbs are grouped into three ranges, including a short wave (UV-C) range extending between 180–280 nm, a medium wave (UV-B) range between 280–320 nm, and a long wave (UV-A) range between 320–400 nm. The UV-C range may be used for sterilization. The UV light bulbs 570A and 570B may preferably emit UV light in the UV-C range, between 180–280 nm, although other wavelengths are also possible. The UV light may function to sterilize the air, sterilizing unwanted airborne contaminants as the air travels adjacent to the UV light bulbs 570A and 570B. In one example embodiment, the Bio-Fighter UV-C Light System manufactured by Dust Free of Royse City, Tex. was used as the UV sterilization system.

B. Ozone Filtration System

Another example filtration system that can be disposed within the air plenum of a fireplace is an ozone filtration system including an ozone generator. An ozone generator creates trivalent oxygen ($O_3$), otherwise known as ozone. The ozone may function to break down airborne contaminants when an oxygen atom from the ozone attaches itself to an airborne contaminant, causing the breakdown of the contaminant into harmless byproducts such as water vapor and carbon dioxide.

An ozone filtration system including an ozone generator may be disposed in the air plenum system of a fireplace to generate and release ozone into the air passing through the plenum system, thereby reducing airborne contaminants. Ozone may be created by the ozone filtration system using any known technique, such as, for example, corona discharge (i.e. a high voltage electrical discharge) or UV light.

C. Germicidal Agents Coating System

Another example filtration system may include a filter system having a coating of germicidal agents. Any filter, such as filter 150, may be coated with a germicidal agent that functions to sterilize airborne contaminants trapped in the filter as the air is filtered.

Examples of such germicidal coatings include a polymer hexyl-PVP developed at the Massachusetts Institute of Technology and the Ultra Aseptic Coating (item code TORDUR-CAG5) available from Decorating Direct Limited in Redcar, United Kingdom. Other germicidal coatings can also be used.

D. Channeled System of Passages

Figure 6:
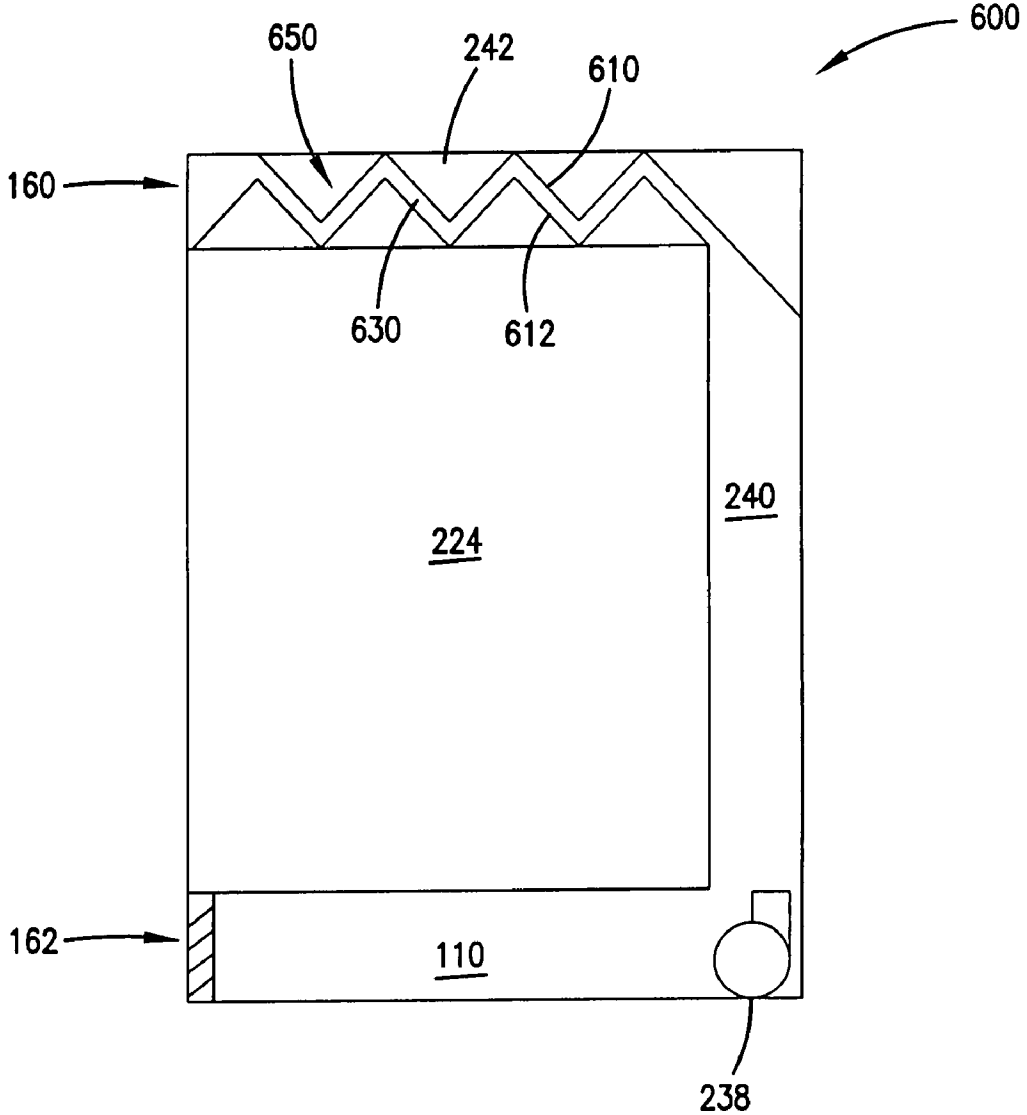
FIG. 6 illustrates a schematic side cross-sectional view of another example fireplace including example embodiments of air filtration and sterilization systems made in accordance with the present invention.

An example fireplace 600 is shown in cross-section in FIG. 6. The fireplace 600 is similar to that of fireplaces 100 and 300, except that the fireplace 600 includes an example air sterilization system 650. The air sterilization system 650 may consist of a plurality of undulating panels, such as 610 and 612, forming a channeled system of passages 630 positioned adjacent the combustion chamber 224. The system of passages 630 may include a plurality of undulations or twists. In this configuration, the passages 630 function to slow the flow of room air through the passages 630, thereby allowing for greater heating of the room air. The additional heating of the air in the passages 630 functions to sterilize a greater percentage of the airborne contaminants. In this manner, the air is sterilized as it passes through the passages 630 and out the air exhaust 160.

Figure 7:
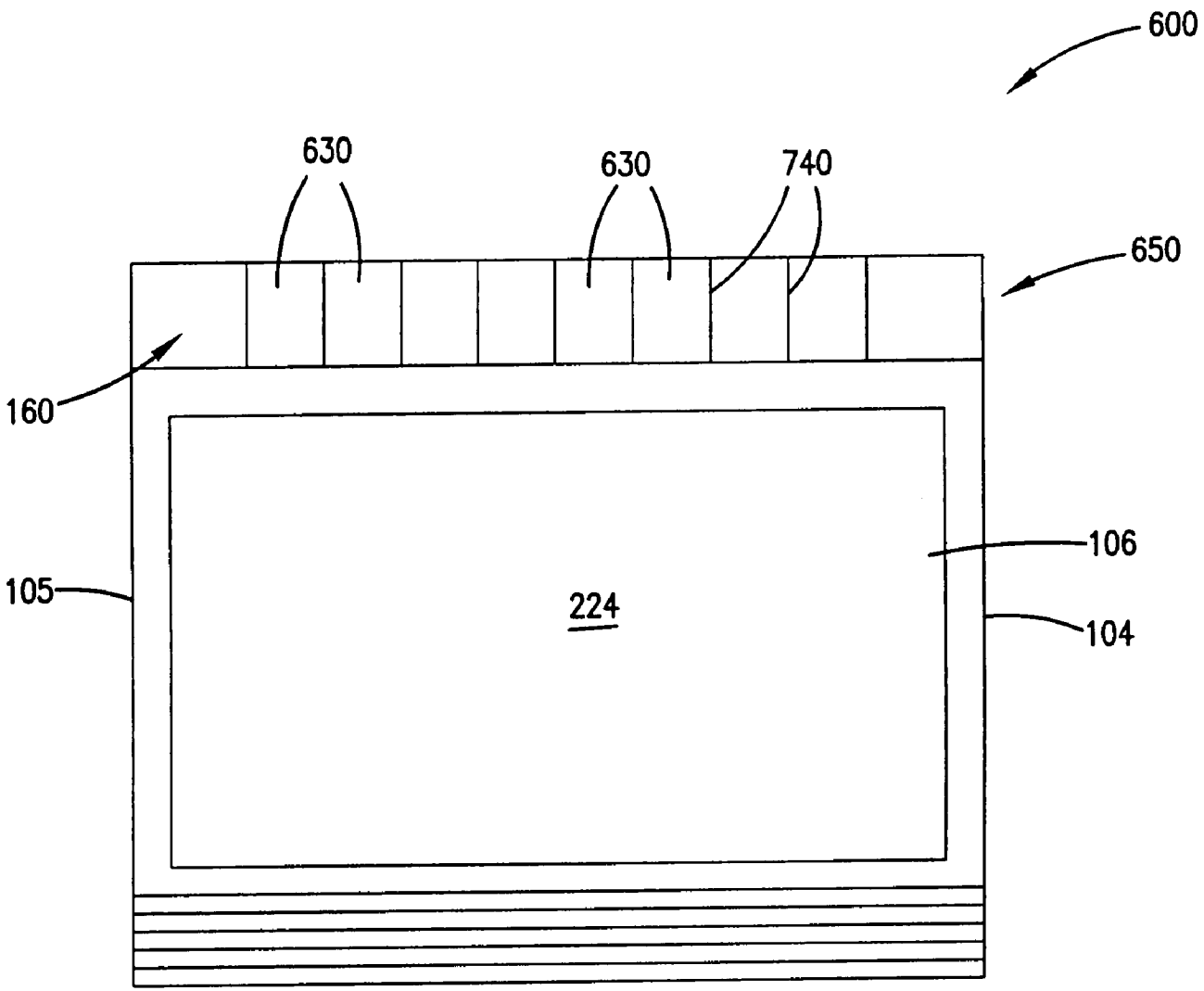
FIG. 7 illustrates a schematic front view of the fireplace of FIG. 6.

Referring now to FIG. 7, a partial front view of the fireplace 600 is provided illustrating the air sterilization system 650. As shown in the example embodiment, a plurality of passages 630 are provided through which the air may flow, each passage being divided by a panel 740.

The system 650 shown in FIGS. 6 and 7 are provided as an example only, and other configurations may also be used to create the necessary slowing and heating of the air for sterilization. For example, instead of a plurality of passages 630, the system 650 may include only a single passage 630 through which the air may travel.

IV. Alternative Embodiments

Figure 8:
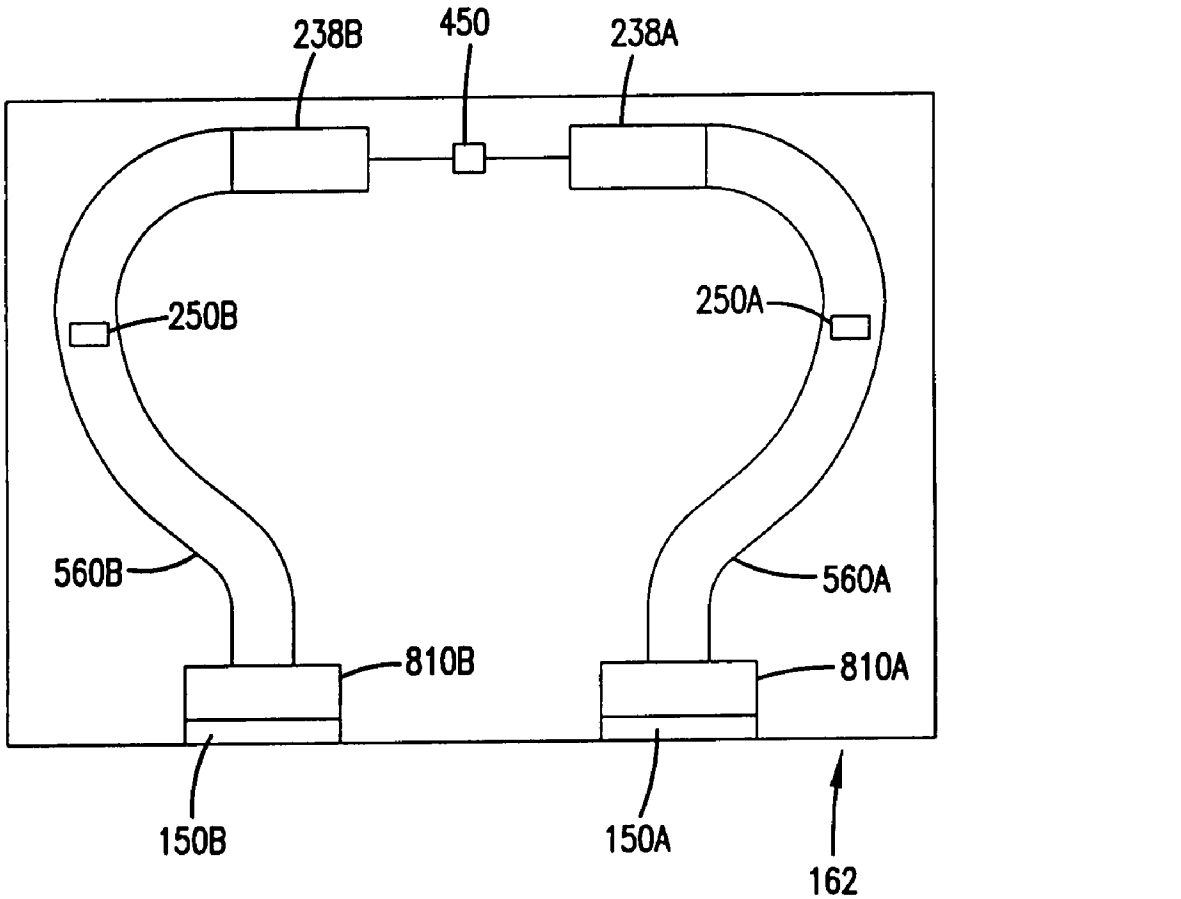
FIG. 8 shows a schematic bottom cross-sectional view of another example fireplace including an example embodiment of intake boxes and example embodiments of air filtration systems made in accordance with the present invention.

In another example embodiment of a fireplace 800 shown in the cross-section view of FIG. 8, filters 150A and 150B are disposed in boxes 810A and 810B. The boxes 810A and 810B allow each filter 150A and 150B to include more filter media than filters 150A and 150B used in the fireplace 300 and therefore filter a greater amount of air. In addition, the large filter boxes 810A and 810B allow for a reduced pressure drop across the filters 150A and 150B, thereby increasing the flow of air through the fireplace and air filtration systems.

Also included in the example embodiment shown in FIG. 8 are filtration systems 250A and 250B disposed within the ducts 560A and 560B. The systems 250A and 250B may be, for example, ion generators that are configured to release a plurality of negatively charged ions. Other configurations, as expressed below, are also possible.

Figure 9:
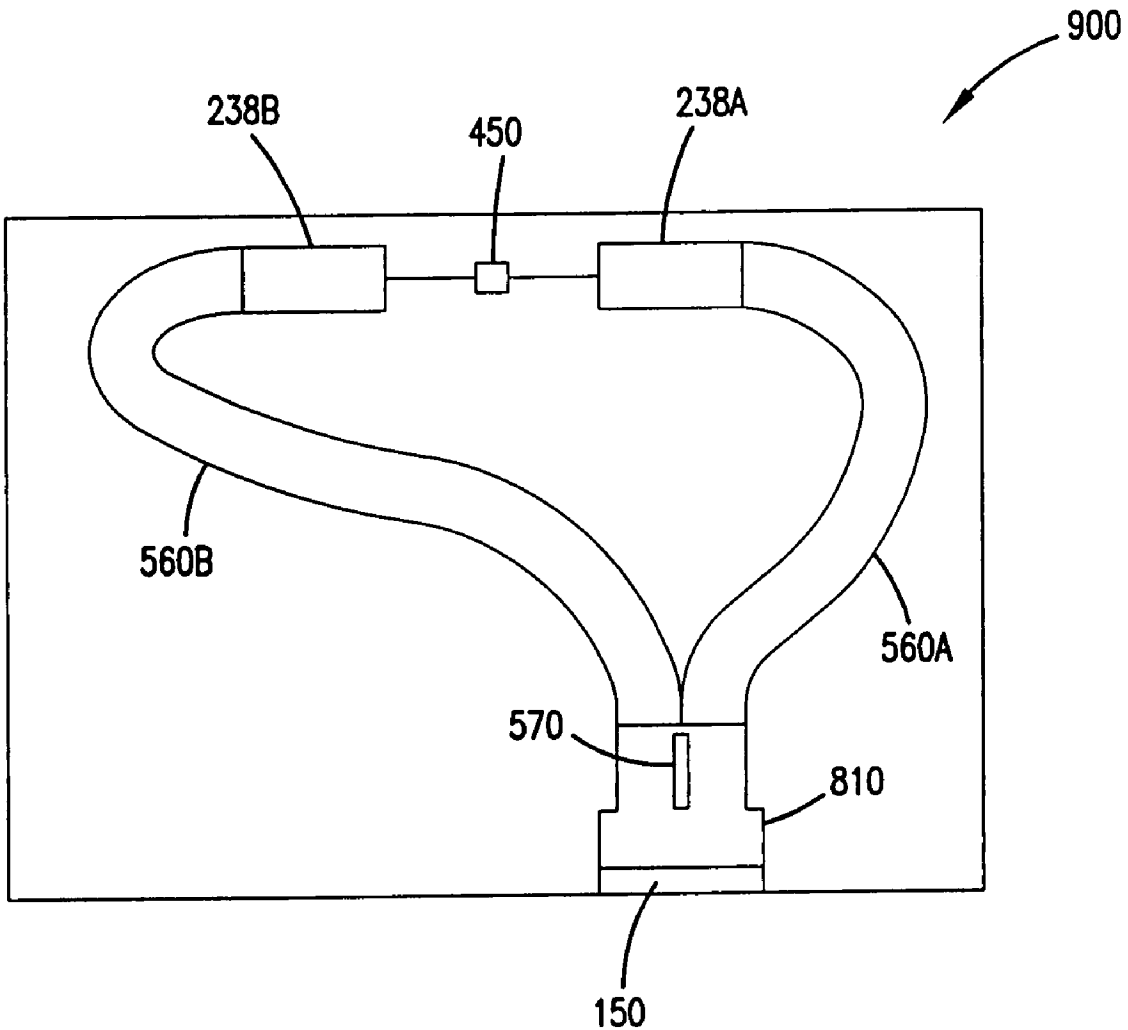
FIG. 9 illustrates a schematic bottom cross-sectional view of another example fireplace including a single intake box and example embodiments of air filtration and sterilization systems made in accordance with the present invention.

In another example embodiment of a fireplace 900 shown in the cross-sectional view of FIG. 9, the fireplace 900 is similar to that of fireplace 800, except that the ducts 560A and 560B are both coupled to a single box 810. The duct 560B branches away from the duct 560A, and the duct 560B is coupled to the blower 238B in a manner similar to that shown in other embodiments. This configuration may be advantageous, for example, to reduce the space taken within the passage 100 by the ducts 560A and 560B. Also included in the box 810 of the fireplace 900 is a UV sterilization system including a UV light bulb 570 to sterilize the air passing through the box 810.

In another example embodiment according to the invention, a self-contained system may include one or more of the filtration and/or sterilization systems described above. This self-contained system may include a housing containing the filtration and/or sterilization systems, and may be placed in any desired location in a room or other structure. For example, the self-contained system may include one or more filters, such as, for example, the filter 150 or 250. In addition, the self-contained system may include a UV sterilization system with a UV light bulb such as 560A or 560B.

V. Optional Components

One or more of the fireplaces including one or more of the filtration and/or sterilization embodiments described above may include one or more example embodiments of the optional components described below.

A. Filter Replacement Warning System

Figure 10:
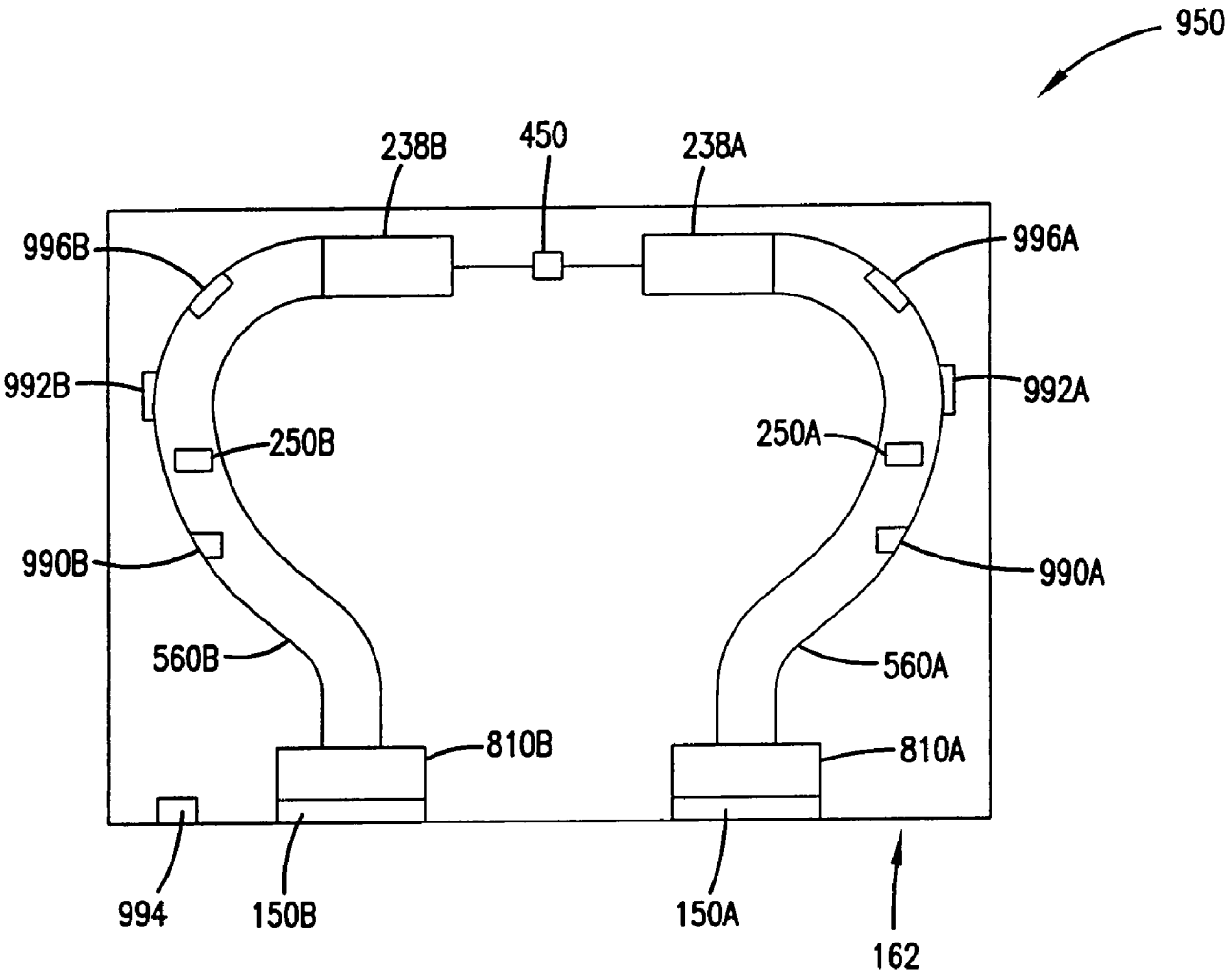
FIG. 10 illustrates a schematic bottom cross-sectional view of another example fireplace including example optional components made in accordance with the present invention.

Included in fireplace 950 of FIG. 10 is an optional example of a filter replacement warning system 990A and 990B. The warning system 990A and 990B may be disposed within one or both ducts 560A and 560B and may function to warn when the end of the useful life of a filter, such as the filters 150A and 150B, has been reached. The end of the useful life of a filter may be a point at which the filter has accumulated sufficient airborne contaminants, or has degraded sufficiently, that replacement is suggested. The warning system 990A and 990B may determine the end of useful life using a variety of methods. For instance, in a first example embodiment the warning system 990A and 990B may log the number of hours of use of the filters 150A and 150B and generate a visual or audible alarm when a predefined period of use has been exceeded.

In a second example embodiment, the warning system 990A and 990B may include a flow sensor that measures a pressure differential in an air passage such as, for example, one or both of the ducts 560A and 560B. As the filters 150A and 150B accumulate airborne contaminants, the air flowing through the filters 150A and 150B will be reduced, thereby reducing the pressure of the air drawn through the ducts 560A and 560B by the blowers 238A and 238B. The flow sensor of the warning system 990A and 990B may detect this pressure drop in the ducts 560A and 560B and generate an alarm when the pressure drops to a predefined level, thereby signifying that the filters 150A and 150B have reached the end of their useful life.

The warning system 990A and 990B may generate an audible alarm to warn a user that a filter needs to be replaced. Alternatively, the warning system may generate a visual alarm, such as by lighting a light, to notify a user to replace a filter. Other warning methods may also be used.

B. Automatic Initiation Sensors

The fireplace 950 may also include one or more optional example automatic initiation sensors 992A, 992B and 994. Sensors 992A and 992B are shown coupled to the ducts 560A and 560B, respectively, and may function to emit light from, for example, one or more light emitting diodes (LEDs). The light may reflect off of airborne contaminants, and the sensors 992A and 992B may function to measure the refraction or absorption of the light by the airborne contaminants. Based on these measurements, the sensors 992A and 992B can function to turn on or off one or more filtration and/or sterilization systems provided with the fireplace 950.

For example, the sensors 992A and 992B may measure airborne contaminants as air flows through the ducts 560A and 560B, and when the amount of airborne contaminants reaches or exceeds a given level, the sensors 992A and 992B can automatically initiate filtration and/or sterilization by activating the UV lights 250A and 250B and the blowers 238A and 238B, if they are not already on. In addition, when the sensors 992A and 992B sense that the level of airborne contaminants is reduced below a given threshold, the sensors 992A and 992B may turn off the blowers and/or UV lights 250A and 250B. In this manner, the sensors 992A and 992B may function independently from the fireplace 950 by turning on and off filtration and/or sterilization when the amount of airborne contaminants warrants, regardless of whether or not the fireplace 950 is currently being used.

The sensor 994 may function to monitor when there is activity in the room in which the fireplace 950 is placed and turn on filtration and sterilization when a given level of activity is sensed. For example, the sensor 994 may use infrared technology, as is known in the art, to measure heat generated by organisms to measure when the room is occupied. In addition, the sensor 994 may use other methods, such as sense for sound created by organisms within the room. If occupation of the room is detected by the sensor 994, the sensor 994 can initiate filtration and/or sterilization of the air by, for example, the filters 150A and 150B and UV lights 250A and 250B. It may be advantageous to initiate filtration and/or sterilization when the room is occupied because movement in the room may disturb or agitate contaminants in the room, causing the particulate to become airborne. The filtration and/or sterilization systems can then remove these undesirable airborne contaminants.

C. System for Air Enhancement

Another example optional component in the fireplace 950 is a system 996A and 996B for enhancement of the air flowing through the fireplace. The system 996A and 996B may be disposed in one or both of the ducts 560A and 560B, respectively. Unlike the filtration and sterilization systems that remove undesirable airborne contaminants, the enhancement system may introduce desirable materials, in solid, liquid, or gaseous form, into the air. For example, the following materials, not meant to be an exhaustive list, may be added to the air flowing through a fireplace:

(1) water—to humidify the air;
(2) fragrances, incenses, and other air deodorizers—to enhance the fragrance of the air;
(3) chemicals—to simulate the smell of a natural fire; and
(4) other known therapeutic agents—to assist in healing or health-enhancing processes.

The system 996A and 996B may function to introduce these, as well as other materials known in the art, into the air flowing through the ducts 560A and 560B. The air may then carry the material out of the fireplace 950 and into the room in which the fireplace is disposed.

The filtration systems described above, including the particulate, chemical, and ion filters, and the sterilization systems, including the UV system, ozone system, germicidal coating system, and the channeled system of ducts, as well as the optional components, may be utilized individually or in combination to reduce the amount of airborne contaminants and enhance the air circulated through a fireplace and into a room. In this manner, it is possible to enjoy the benefits of a fireplace while reducing the amount of airborne contaminants.

The present invention should not be considered limited to the particular examples or materials described above, but rather should be understood to cover all aspect of the invention as fairly set out in the attached claims. Various modifications, equivalent processes, as well as numerous structures to which the present invention may be applicable will be readily apparent to those of skill in the art to which the present invention is directed upon review of the instant specification.

What is claimed is:

1. A fireplace including an air filter, the fireplace comprising:

a combustion chamber enclosure having at least top, bottom and rear panels and defining a combustion chamber for the combustion of fuel;

an outer enclosure including a plurality of panels that define an inner volume sized to receive the combustion chamber enclosure, the plurality of panels being positioned relative to the enclosure to form a plenum defining an air passage that extends around an outer surface of at least the top, bottom and rear panels of the combustion chamber enclosure, the air passage having an air intake into the air passage and an air exhaust out of the air passage; and a filter disposed within the air passage below the combustion chamber to limit the exposure of the filter to heat generated in the combustion chamber;

wherein the fireplace is configured for the flow of intake air into the air passage through the air inlet thereby causing the intake air to pass through the filter to remove airborne contaminants from the intake air, and is configured for exhausting the filtered intake air out of the air passage through the air exhaust.

2. The fireplace of claim 1, further comprising a blower configured to draw intake air into the air passage and force intake air out of the air passage.

3. The fireplace of claim 1, further comprising a sterilizer configured to sterilize the intake air in the air passage.

4. The fireplace of claim 1, wherein the air passage is positioned outside of the combustion chamber.

5. The fireplace of claim 1, wherein air passage is configured and arranged to isolate air passing through the air passage from passing through the combustion chamber.

6. The fireplace of claim 1, wherein the combustion chamber enclosure further includes a front panel, the front panel configured to prevent the flow of air into or out of the air passage from passing into the combustion chamber.

7. A method of filtering air using a heating appliance, the heating appliance including a combustion chamber enclosure, an outer enclosure, a filter, and an air plenum having an air intake and an air exhaust, the method comprising the steps of:

disposing the combustion chamber enclosure at least partially within the outer enclosure;

arranging the plenum between the combustion chamber enclosure and the outer enclosure with the air intake positioned vertically below the combustion chamber enclosure and the air exhaust positioned vertically above the combustion chamber enclosure;

disposing the filter within the plenum, the filter disposed on a heat shield placed between the combustion chamber and the filter to protect the filter from heat generated in the combustion chamber; and drawing intake air into the plenum through the air intake, passing the intake air only through the plenum, and exhausting the intake air out of the plenum through the exhaust outlet, whereby the intake air is filtered by the filter.

8. The method of claim 7, wherein the heating appliance further includes a blower, and the method further comprises drawing in and exhausting intake air with the blower.

9. The method of claim 7, wherein the heating appliance further includes an air sterilizer, and the method further includes positioning the air sterilizer within the plenum and sterilizing the intake air.

10. A method of filtering air in a heating appliance, the heating appliance including a combustion chamber enclosure, an outer enclosure, an air plenum, and a filter, the method comprising the steps of:

positioning the combustion chamber enclosure at least partially within the outer enclosure;

positioning the plenum in its entirety between the combustion chamber enclosure and the outer enclosure;

positioning the filter within the plenum and spaced vertically below the combustion chamber to limit the exposure of the filter to heat generated in the combustion chamber;

drawing air into the plenum as intake air; and moving the intake air through the filter thereby filtering the intake air.

11. A fireplace including an air filter, the fireplace comprising:

a combustion chamber enclosure defining a combustion chamber for the combustion of fuel;

an outer enclosure defining an inner volume sized to receive the combustion chamber enclosure;

a plenum disposed in its entirety between the combustion chamber enclosure and the outer enclosure and defining an airflow path; and a filter disposed within the plenum at a position along the airflow path between inlet and outlets to the plenum, wherein the inlet and outlets to the plenum are fluidly separated from the combustion chamber;

a heat shield placed between the combustion chamber and the filter, wherein the heat shield protects the filter from heat generated in the combustion chamber;

wherein the fireplace is configured to draw air into the plenum as intake air, move intake air through the filter to filter the intake air, and exhaust the filtered air out of the plenum.

12. The fireplace of claim 11, further comprising a front panel mounted to a vertically oriented front surface of the combustion chamber enclosure, wherein the front panel comprises a transparent material that provides viewing into the combustion chamber, and the front panel prevent fluids within the combustion chamber from entering into the plenum.

13. A heating appliance, comprising:

a combustion chamber enclosure having at least top, bottom and rear panels and defining a combustion chamber for the combustion of fuel;

an outer enclosure including a plurality of panels that define an inner volume sized to receive the combustion chamber enclosure, the plurality of panels being positioned relative to the enclosure to form a plenum defining an air passage around at least the top, bottom and rear panels of the combustion chamber enclosure, the air passage having an air intake into the plenum that is positioned vertically below the bottom panel and an air exhaust out of the plenum that is positioned vertically above the top panel;

a sterilization system disposed within the air passage; and a blower disposed in the plenum below the bottom panel, the blower being configured to draw intake air into the air passage through the air intake and force air out of the air passage through the air exhaust;

wherein when air moving through the air passage from the air inlet to the air exhaust passes through the sterilization system, the sterilization system incapacitates airborne contaminants in the air.

14. The fireplace of claim 13 further comprising a secondary air path disposed within the plenum, the secondary air path comprising at least one air duct wherein air is drawn into the at least one air duct by at least one blower, the sterilization system disposed within the at least one air duct.

* * * * *